US005600428A

United States Patent [19]

Yanagida

[11] Patent Number: 5,600,428

[45] Date of Patent: Feb. 4, 1997

[54] SHEET SEPARATOR FOR AN IMAGE FORMING APPARATUS

[75] Inventor: Masato Yanagida, Tokyo, Japan

[73] Assignee: Ricoh Company, Ltd., Tokyo, Japan

[21] Appl. No.: 346,186

[22] Filed: Nov. 22, 1994

[30] Foreign Application Priority Data

Nov. 30, 1993 [JP] Japan ..... 5-299688
Oct. 11, 1994 [JP] Japan ..... 6-245646

[51] Int. Cl.[6] ..... G03G 21/00

[52] U.S. Cl. ..... 399/399; 271/900

[58] Field of Search ..... 355/315; 271/307, 271/311, 900

[56] References Cited

U.S. PATENT DOCUMENTS 4,748,473 5/1988 Tsuruoka ..... 271/900 X 5,392,108 2/1995 DeWaters et al. ..... 355/315

*Primary Examiner*—William J. Royer

*Attorney, Agent, or Firm*—Oblon, Spivak, McClelland, Maier & Neustadt, P.C.

[57] ABSTRACT

In an image forming apparatus of the type developing an electrostatic latent image formed on an image carrier by using toner having a softening point of 80° C. or below and transferring the resulting toner image to a sheet, a sheet separator separates, after the image transfer, the sheet from the surface of the image carrier while making sliding contact therewith at an edge portion thereof. The edge portion has a tip contacting the surface of the image carrier and has a particular radius of curvature.

1 Claim, 6 Drawing Sheets

SHEET SEPARATOR FOR AN IMAGE FORMING APPARATUS

BACKGROUND OF THE INVENTION

The present invention relates to an electrophotographic apparatus, facsimile apparatus, printer or similar image forming apparatus and, more particularly, to a sheet separator for separating, after the transfer of a toner image, a sheet carrying the toner image from the surface of a photoconductive element in sliding contact with the element.

It has been customary with an image forming apparatus to transfer a toner image from a photoconductive element, or image carrier, to a sheet contacting it by, for example a bias applied from a charger. After the image transfer, the sheet carrying the toner image has to be separated from the photoconductive element. To insure the sheet separation, a sheet separator is usually held in sliding contact with the surface of the photoconductive element. A sheet separator has been proposed in various forms in the past. For example, Japanese Patent Laid-Open Publication No. 3-33779 teaches a sheet separator configured to obviate noise due to the vibration of the separator contacting a photoconductive element. Japanese Patent Laid-Open Publication No. 3-245137 discloses a sheet separator which does not scratch or otherwise damage the surface of a photoconductive element despite the sliding contact thereof with the element.

On the other hand, a current trend in the imaging art is toward the use of toner having a softening point as low as 80° C. or below in order to lower power necessary for a fixing unit. As to the term "softening point", a flow tester available from Shimazu Seisaku-Sho (Japan) is used for the measurement. Specifically, while a load of 10 kg/cm$^2$ is constantly applied to toner, temperature sequentially raised by 3° C. every minute. A vessel included in the flow tester is formed with perforations having a diameter of 0.5 mm. Although the volume of the toner sequentially decreases due to the load, it begins to increase when the temperature reaches a certain level. The term "softening point" refers to the temperature at which the volume of the toner begins to increase after the decrease. As the softening point of the toner lowers, filming is more apt to occur on the surface of the photoconductive element due to the loner. Particularly, since the surface of the photoconductive element and the edge of the sheet separator are healed due to friction, toner which enters the interface between them aggravates filming due to the weight of the separator as well as to the temperature. With the conventional sheet separators stated earlier, it is impossible to solve such a toner filming problem.

SUMMARY OF THE INVENTION

It is, therefore, an object of the present invention to provide a sheet separator for an image forming apparatus which prevents toner from forming a film on a photoconductive element even when it has a softening point of 80° C. or below.

In accordance with the present invention, in an image forming apparatus for forming an electrostatic latent image on an image carrier, developing the latent image with toner having a softening point of 80° C. or below to produce a corresponding toner image, and then transferring the toner image to a sheet, a sheet separator for separating, after the image transfer, the sheet from the surface of the image carrier while making sliding contact with the surface at an edge portion thereof has a radius of curvature of 0.04 mm or below at a tip of the edge portion which contacts the surface of the image carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
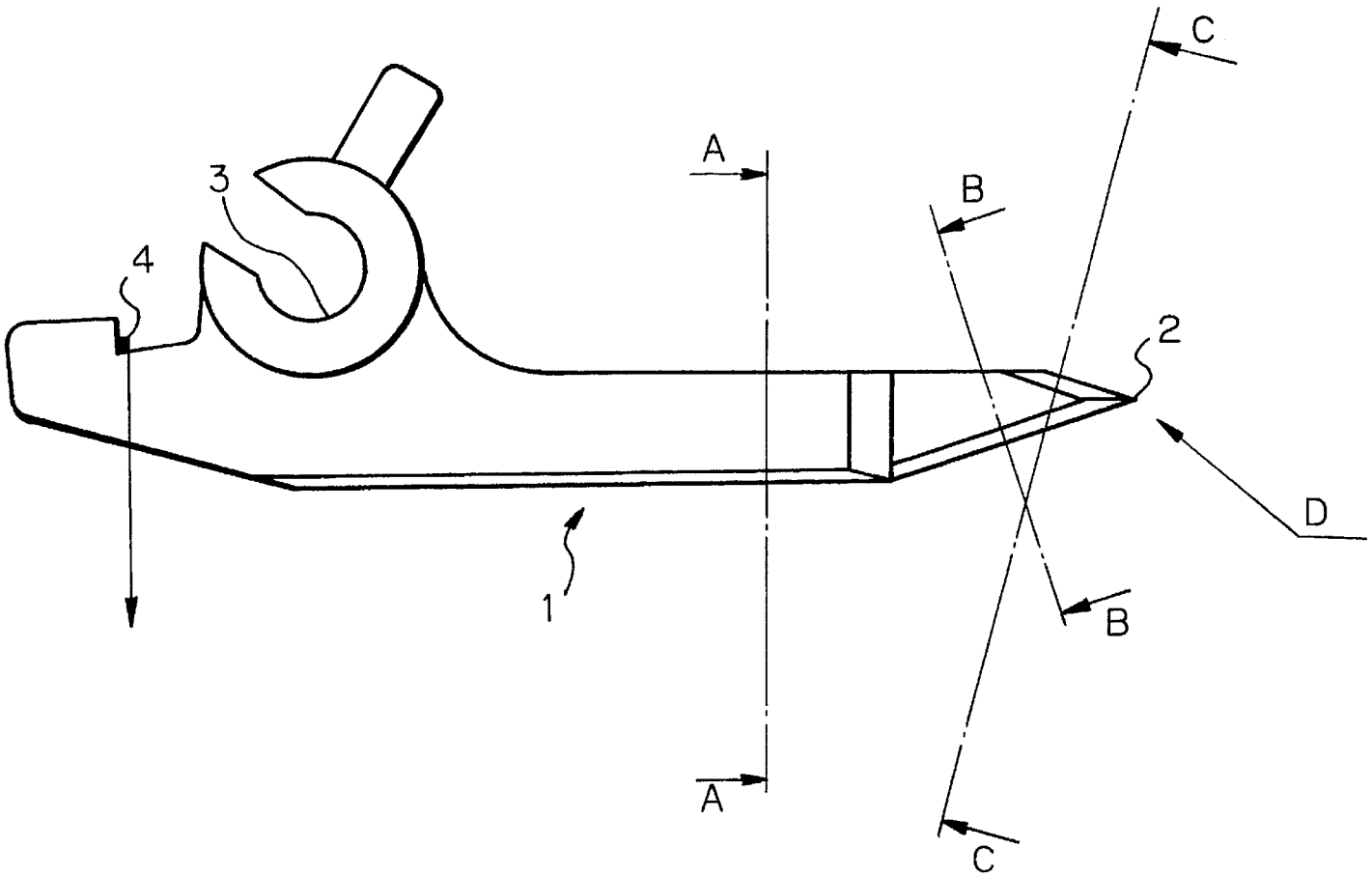
FIG. 1 is a front view of a sheet separator embodying the present invention.
Figure 2:
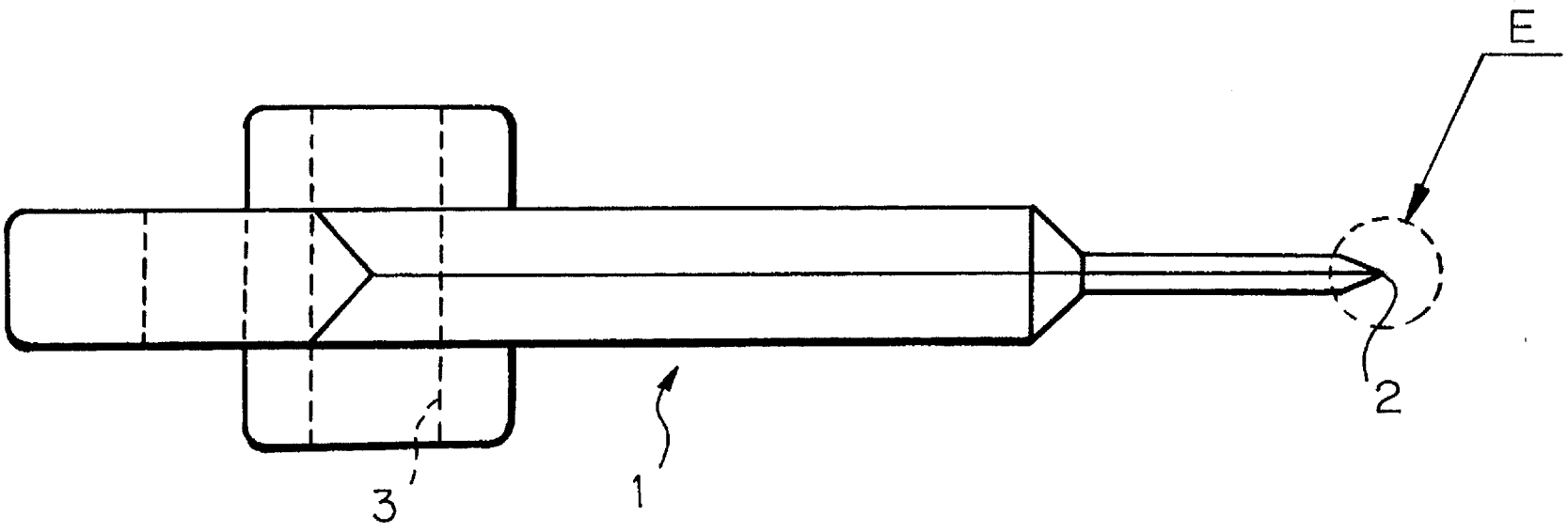
FIGS. 2 and 3 are respectively a bottom view and a side elevation, as seen from the right, of the sheet separator.
Figure 3:
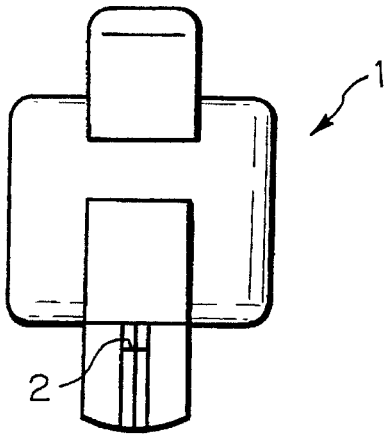
Figure 4A:
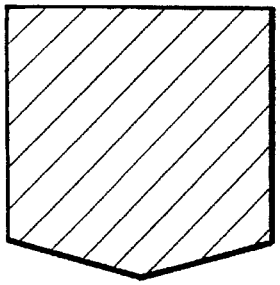
FIGS. 4A, 4B and 4C are respectively sections along lines A—A, B—B and C—C shown in FIG. 1.
Figure 4B:
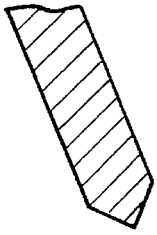
Figure 4C:
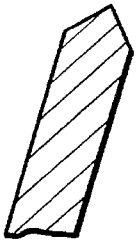

Referring to FIG. 1 of the drawings, a sheet separator embodying the present invention is shown and generally designated by the reference numeral 1. As shown, the sheet separator 1 has a portion 3 which is rotatably mounted on a shaft included in an image forming apparatus, as will be described specifically later. The sheet separator 1 is constantly biased in a direction indicated by an arrow in the figure at a load point 4 thereof, so that a force tending to rotate it about the portion 3 acts. The rotation of the sheet separator 1 due to such a force is limited when the edge portion 2 thereof abuts against a photoconductive element, which will also be described later and is a specific form of an image carrier. The sheet separator 1 separates a sheet from the photoconductive element by using the force with which the edge portion 2 thereof abuts against the photoconductive element. FIGS. 2, 3 and 4A–4C show the sheet separator 1 in different views from FIG. 1.

Figure 5:
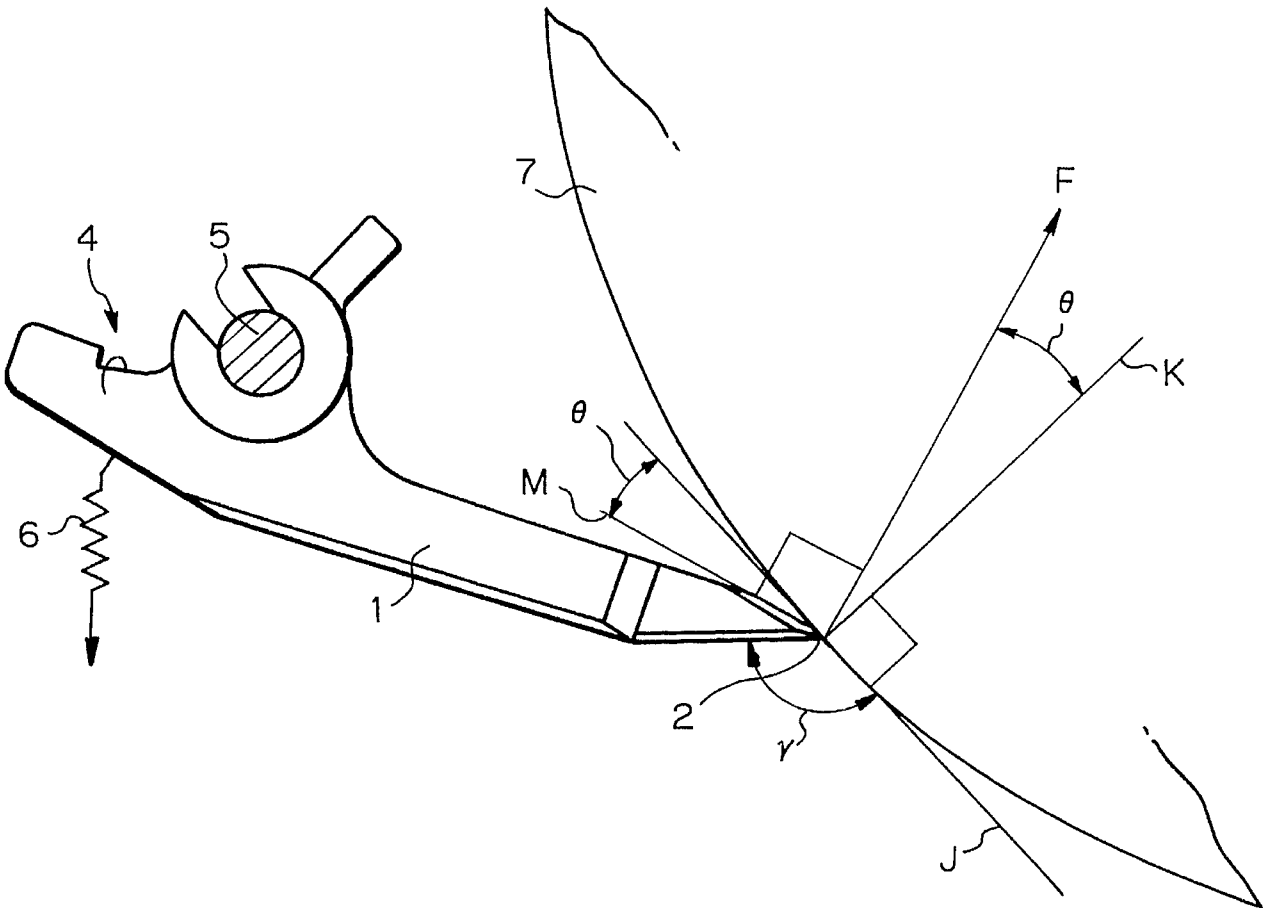
FIG. 5 shows the sheet separator contacting the surface of a photoconductive element.

FIG. 5 shows the sheet separator 1 contacting a photoconductive drum 7 at the edge portion 2 thereof. As shown, the portion 3 of the sheet separator 1 is rotatably mounted on a shaft 5. A tension spring 6 constantly biases the sheet separator 1 at the load point 4 in a direction indicated by an arrow in the figure. A line tangential to the drum 7 at a contact point where the edge portion 2 contacts the drum 7 and a line normal to the tangential are labeled J and K, respectively. The normal K extends through the center of rotation of the drum 7. The tangential J and a line M extending from the contact point along the upper end of the edge portion 2 make an angle θ therebetween. Let the angle θ be referred to as the contact angle of the sheet separator 1. The force F with which the edge portion 2 presses the drum 7 acts in a direction which is inclined relative to the normal K by the same angle as the contact angle θ.

Figure 6:
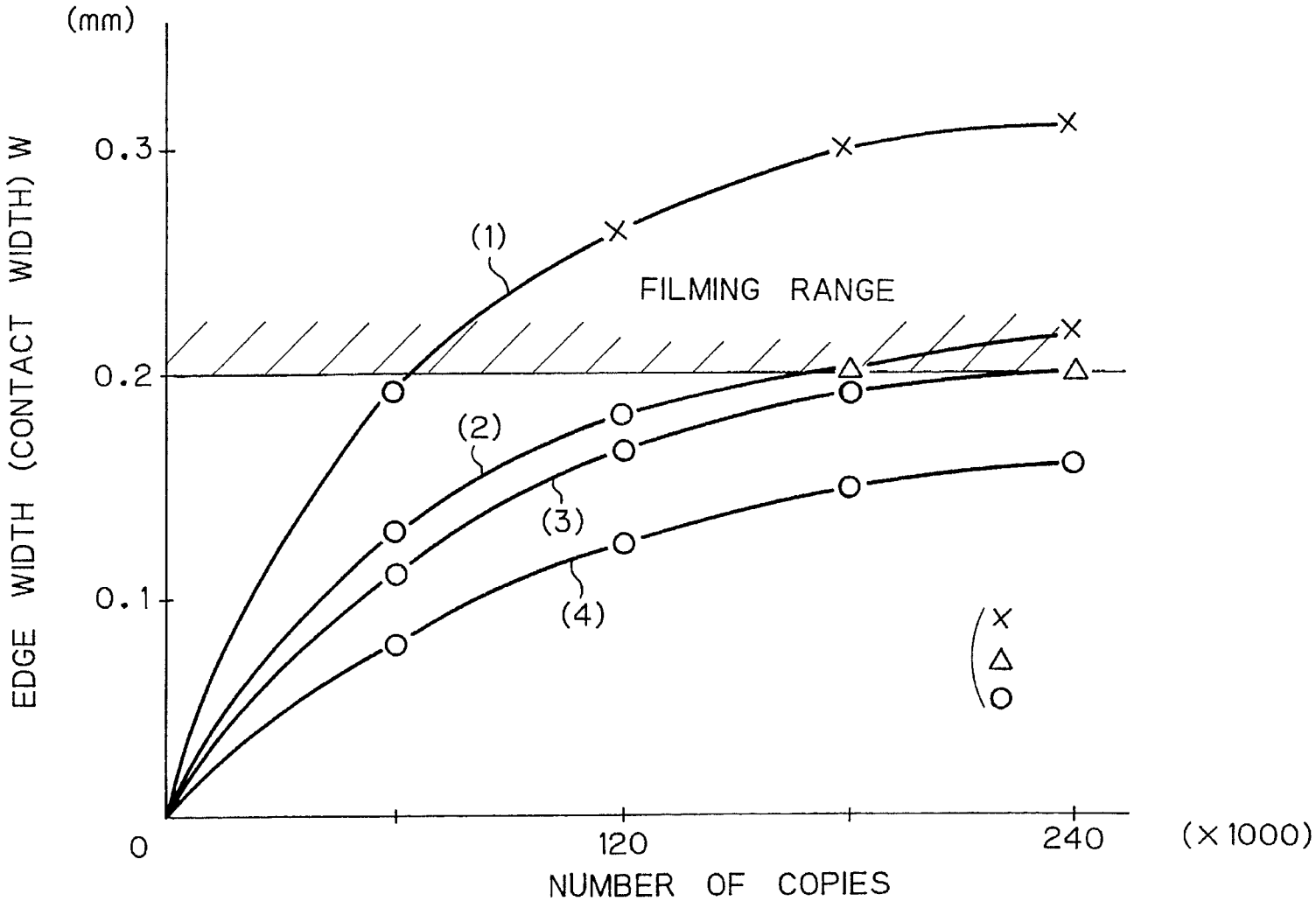
FIG. 6 is a graph showing experimental results as to filming and particular to different kinds of sheet separators.
Figure 7:
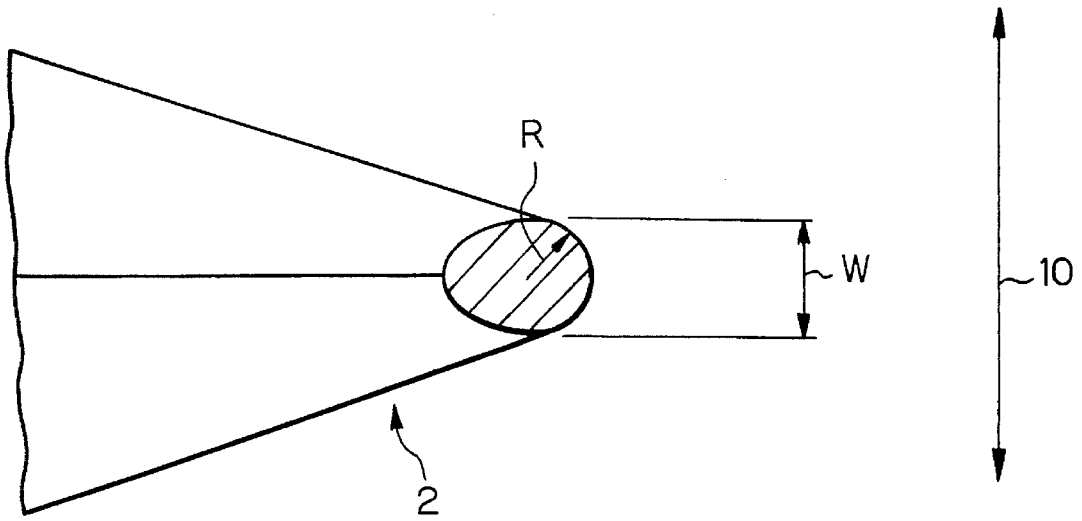
FIG. 7 is an enlarged view of the edge of the sheet separator.

Assume that toner has a softening point T. In the illustrative embodiment, the softening point T, angle θ and force F are selected to be 79° C., 17.6° (γ=129°) and 0.9 gf, respectively. Under these conditions and with the sheet separator 1 made of polyamide imide, experiments were conducted to determine how filming occurs on the photoconductive drum 7. During the experiments, the hardness of the sheet separator 1 and the radius of curvature of the tip of the edge portion 2 were changed. The results of experiments are shown in FIG. 6. Regarding the term "radius of curvature of the tip of the edge portion 2", FIG. 7 is an enlarged view of the portion of the sheet separator 1 enclosed by a circle E in FIG. 2. In FIG. 7, the right half of the part indicated by hatching has a radius R which is the radius of curvature mentioned above. The edge portion 2 contacts the drum 7 over the hatched area shown in FIG. 7. While the edge portion 2 initially makes point-to-point contact with the drum 7, it sequentially wears due to repeated copying until it forms a circular contact portion and makes surface-to-surface contact with the drum 7. Labeled W is the width of the edge portion 2, i.e., the width over which the edge portion 2 contacts the drum 7. A double-headed arrow 10 indicates a direction parallel to the axis of the drum 7.

Specifically, FIG. 6 shows a relation between the width W of the edge portion 2 and the number of copies determined by experiments with the following four different kinds of sheet separators 1:

(1) Rockwell hardness of 90 and R of 0.15 mm (2) Rockwell hardness of 100 and R of 0.06 mm (3) Rockwell hardness of 100 and R of 0.04 mm (4) Rockwell hardness of 119 and R of 0.03 mm In the figure, curves with numbers (1) to (4) respectively correspond to the above conditions (1) to (4), and circles, triangles and crosses indicate "no filming", "little filming" and "noticeable filming". The Rockwell hardnesses were measured in Scale M.

Rockwell hardnesses of 120 and above are apt to scratch or otherwise damage the drum 7 implemented by an organic photoconductor. Radii of 0.04 and above cause the width W of the edge portion 2 to increase due to aging and, therefore, result in filming easily. As to the width W of the edge portion 2, filming occurs when it exceeds 0.2 mm due to the surface-to-surface contact stated earlier. After 240,000 copies have been produced, the contact width W of the edge portion 2 with the drum 7 decreases to below the limit of 0.2 mm when the hardness is 100 or above. Conversely, even when the hardness is 119, the edge portion 2 scratches or otherwise damages the drum 7 if the angle θ is excessively great. Presumably, therefore, the upper limit of the hardness is about 119.

As stated above, the tip of the edge portion 2 which contacts the drum 7 should have a radius of curvature R of 0.04 mm. Also, the sheet separator 1 should preferably have a Rockwell hardness (scale M) ranging from 100 to 119.

The sheet separator 1 satisfying the above conditions was found not only to eliminate toner filming but also to obviate toner dropping, defective sheet separation, drum scratching and other troubles. In addition, such a sheet separator 1 withstood as many as 240,000 times of copying operation.

While the embodiment has concentrated on an image carrier implemented as a photoconductive drum, it is, of course, practicable with a photoconductive belt or an intermediate image transfer body.

In summary, it will be seen that the present invention provides a sheet separator which prevents toner from forming a film on an image carrier even when the softening point thereof is 80° or below.

Various modifications will become possible for those skilled in the art after receiving the teachings of the present disclosure without departing from the scope thereof.

What is claimed is:

1. In an image forming apparatus for forming an electrostatic latent image on an image carrier, developing said latent image with toner having a softening point of 80° C. or below to produce a corresponding toner image, and then transferring said toner image to a sheet, a sheet separator for separating, after image transfer, said sheet from the surface of said image carrier while making sliding contact with said surface at an edge portion thereof has a radius of curvature of 0.04 mm or below at a tip of said edge portion which contacts said surface of said image carrier, said edge portion has a width of 0.2 mm or less, and said sheet separator is made of resin having a Rockwell hardness (scale M) ranging from 100 to 119.

* * * * *